US006396440B1

(12) United States Patent
Chen

(10) Patent No.: US 6,396,440 B1
(45) Date of Patent: May 28, 2002

(54) PHASED ARRAY ANTENNA APPARATUS

(75) Inventor: Shuguang Chen, Tokyo (JP)

(73) Assignee: NEC Corporation (JP)

( * ) Notice: Subject to any disclaimer, the term of this patent is extended or adjusted under 35 U.S.C. 154(b) by 0 days.

(21) Appl. No.: 09/103,739

(22) Filed: Jun. 24, 1998

(30) Foreign Application Priority Data

Jun. 26, 1997 (JP) ..... 9-170500

(51) Int. Cl.[7] ..... H01Q 1/38; H01Q 13/10

(52) U.S. Cl. ..... 343/700 MS; 343/767; 343/768; 343/770; 343/771; 343/853

(58) Field of Search ..... 343/700 MS File, 343/853, 767–771; H01Q 1/38

(56) References Cited

U.S. PATENT DOCUMENTS 4,554,551 A * 11/1985 Frazita ..... 343/771
4,939,527 A * 7/1990 Lamberty et al. ..... 343/771
4,947,178 A * 8/1990 Shafai ..... 343/700 MS

FOREIGN PATENT DOCUMENTS

JP 57-184303 11/1982
JP 5-145336 6/1993

OTHER PUBLICATIONS

S. Ohmori, et al., "A Phased Array Tracking Antenna for Vehicles", The Institute of Electronics, Information and Communication Engineers, Communication Technical Report, SANE 90–41 (A.P. 90–95), 1990, pp. 33–40.

* cited by examiner

*Primary Examiner*—Don Wong
*Assistant Examiner*—Hoang Nguyen
(74) *Attorney, Agent, or Firm*—Ostrolenk, Faber, Gerb & Soffen, LLP

(57) ABSTRACT

A phased array antenna apparatus includes a plurality of radiation elements, a power supply unit, a power distributor, a feed probe, a plurality of electromagnetic coupling units, and a plurality of phase shifters. The radiation elements are aligned and arranged to be electromagnetically driven. The power supply units supply power to the radiation elements. The power distributor has a pair of conductive plates arranged to be parallel to each other and acts as a radial waveguide distributing the power supplied from the power supply unit to the radiation elements. The feed probe is arranged on one of the conductive plates to radiate an electromagnetic wave into the radial waveguide in accordance with the power supplied from the power supply unit. The electromagnetic coupling units are arranged on the other conductive plate in correspondence with the radiation elements to extract the electromagnetic wave radiated from the feed probe and propagating through the radial waveguide by electromagnetic coupling. The phase shifters control a phase of the electromagnetic wave extracted by the electromagnetic coupling units and supply the electromagnetic wave to the radiation elements.

19 Claims, 5 Drawing Sheets

PHASED ARRAY ANTENNA APPARATUS

BACKGROUND OF THE INVENTION

The present invention relates to a phased array antenna apparatus which electronically changes a phase fed to a plurality of radiation elements to scan a radiation beam.

A phased array antenna apparatus of this type radiates an electromagnetic wave as a radiation beam in a desired direction and therefore is fixed on the ground or mounted on a movable body and used for satellite communication or satellite broadcasting reception.

In the phased array antenna apparatus, power for driving the radiation elements is supplied from a power supply unit and distributed and fed to the radiation elements by a power distributor. A phase shifter is connected between the power distributor and each radiation element. The phase to be fed to each radiation element is changed by controlling the phase shifter.

Each radiation element radiates a wave with a phase corresponding to the fed phase. Therefore, when the phase shifters are controlled such that an equiphase plane is generated by radiation from the radiation elements, a radiation beam can be formed in a direction perpendicular to the equiphase plane.

The conventional power distributor is constituted by a microstrip line for connecting the phase shifter arranged for each radiation element to the power supply unit. However, the microstrip line has a large loss in a high-frequency band. Since the microstrip line is an open line, the radiation loss increases as the frequency rises. In addition, since the high-frequency current flows only through the surface layer due to the skin effect, the transmission loss increases.

As described above, when the conventional phased array antenna apparatus is used in a high-frequency band, the feed loss in the power distributor increases.

SUMMARY OF THE INVENTION

It is an object of the present invention to provide a phased array antenna apparatus which reduces the feed loss in a high-frequency band.

In order to achieve the above object, according to the present invention, there is provided a phased array antenna apparatus comprising a plurality of radiation elements aligned and arranged to be electromagnetically driven, power supply means for supplying power to the radiation elements, power distribution means for distributing the power supplied from the power supply means to the radiation elements, the power distribution means having a pair of conductive plates arranged to be parallel to each other and constituting a radial waveguide, a feed probe arranged on one of the conductive plates to radiate an electromagnetic wave into the radial waveguide in accordance with the power supplied from the power supply means, a plurality of electromagnetic coupling means, arranged on the other of the conductive plates in correspondence with the radiation elements, for extracting the electromagnetic wave radiated from the feed probe and propagating through the radial waveguide by electromagnetic coupling, and a plurality of phase control means for controlling a phase of the electromagnetic wave extracted by the electromagnetic coupling means and supplying the electromagnetic wave to the radiation elements.

DESCRIPTION OF THE PREFERRED EMBODIMENTS

The present invention will be described below in detail with reference to the accompanying drawings. A case wherein an antenna transmits a signal will be described below. Even when the antenna receives a signal, the operation principle is substantially the same because of the reciprocity theorem, and a detailed description thereof will be omitted.

Figure 1:
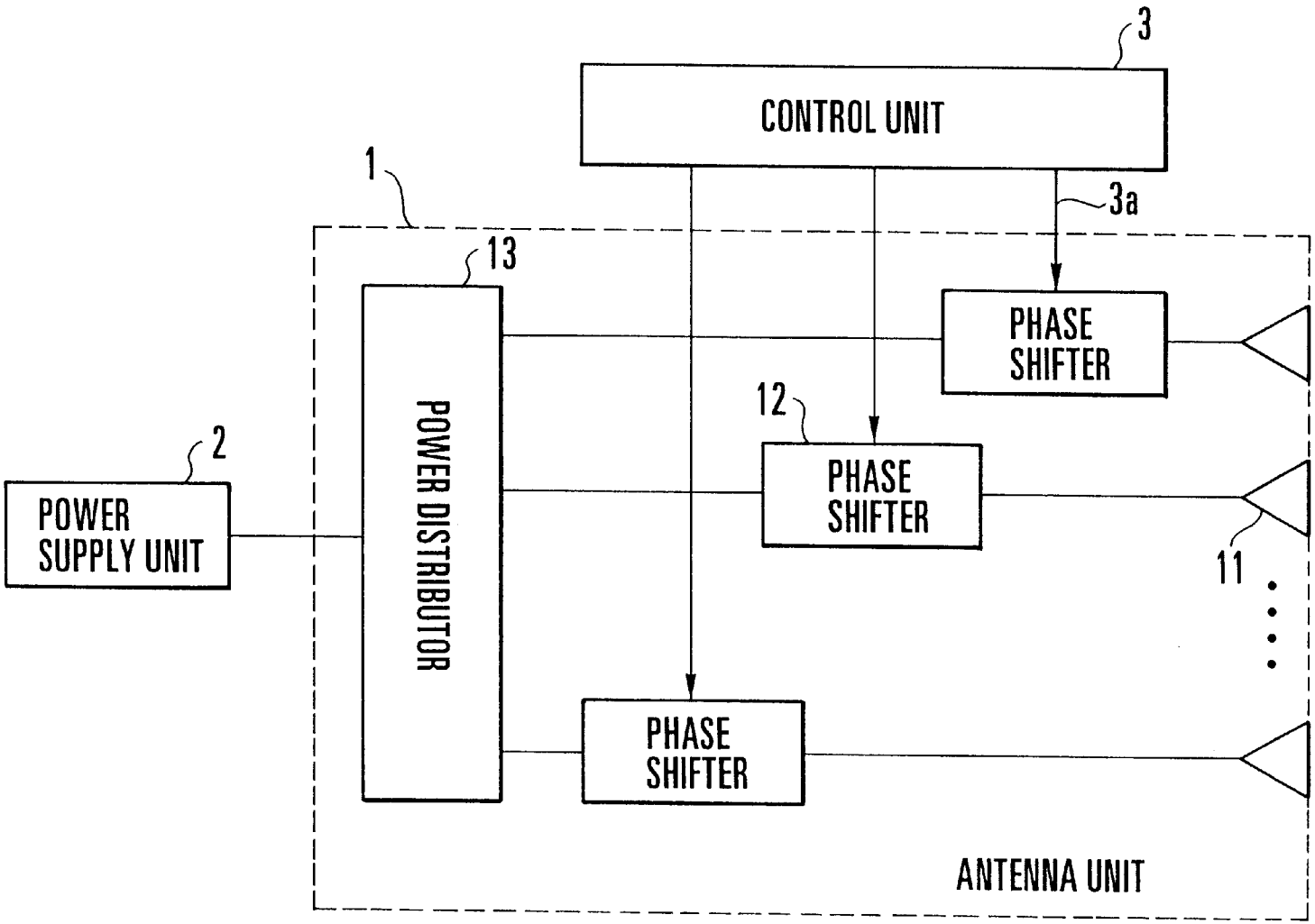
FIG. 1 is a block diagram showing the schematic arrangement of a phased array antenna apparatus according to an embodiment of the present invention.

FIG. 1 shows the schematic arrangement of a phased array antenna apparatus according to an embodiment of the present invention. As shown in FIG. 1, the phased array antenna apparatus of this embodiment has a plurality of radiation elements 11. A phase shifter (phase control means) 12 is connected to each radiation element 11, and a power distributor 13 is connected to the phase shifters 12. A power supply unit (power supply means) 2 is connected to the power distributor 13 through a coaxial cable 2*a*. A control unit 3 is connected to the phase shifters 12 through control lines 3*a* to control the transmitted phase of each phase shifter 12. The radiation elements 11, the phase shifters 12, and the power distributor 13 constitute an antenna unit 1.

The power supply unit 2 supplies power for driving the radiation elements 11. The power distributor 13 distributes the power supplied from the power supply unit 2 to the phase shifters 12. The control unit 3 calculates the optimum fed phase shift amount (transmitted phase) for directing the radiation beam in a desired direction in units of radiation elements 11 on the basis of the positions of the radiation elements 11 and the frequency of the radio wave to be used. The calculated phase shift amounts are set for the phase shifters 12 through the control lines 3*a*.

Each phase shifter 12 changes the phase of power supplied from the power distributor 13 by the phase shift amount set by the control unit 3 and feeds the power to the corresponding one of the radiation elements 11. The radiation elements 11 are driven in accordance with the fed phases from the phase shifters 12. When radiation from the radiation elements 11 forms an equiphase plane, a radiation beam is formed in a direction perpendicular to the equiphase plane.

The phase shifter 12 may contain an amplifier for amplifying the power to be supplied to the radiation element 11. This amplifier may be separated from the phase shifter 12 and connected to the output side of the phase shifter 12. The phased array antenna apparatus of this embodiment uses a microwave.

Figure 2:
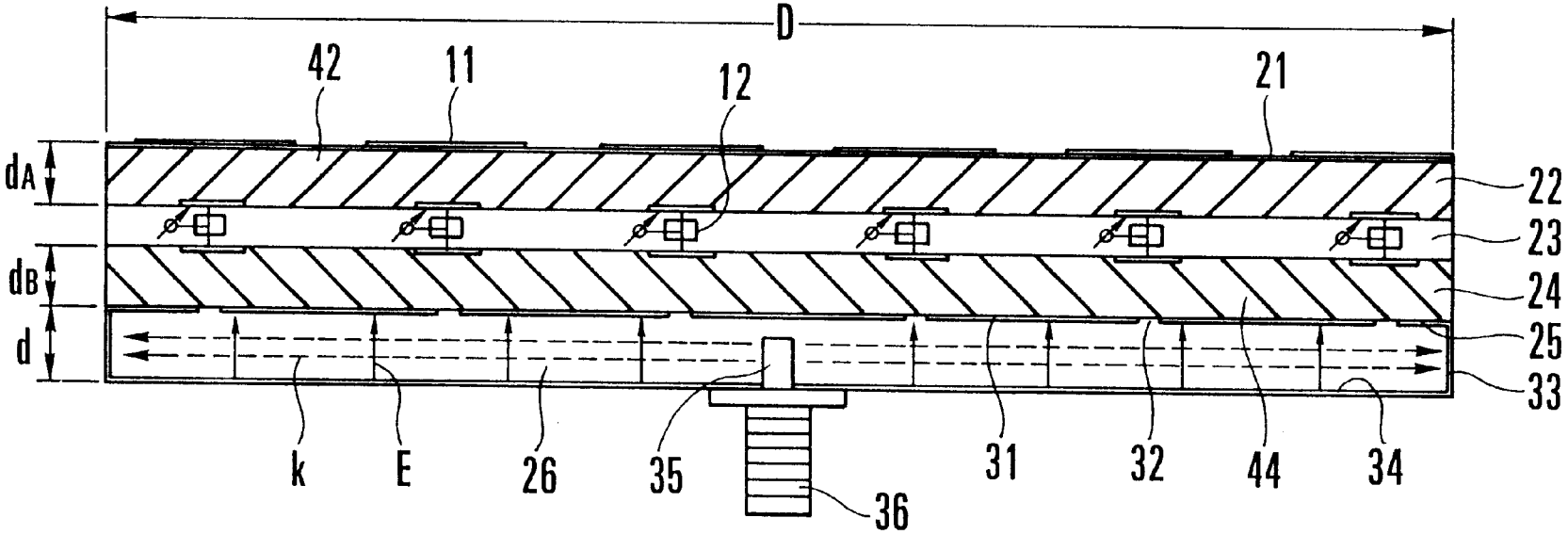
FIG. 2 is a sectional view of an antenna unit shown in FIG. 1.
Figure 3:
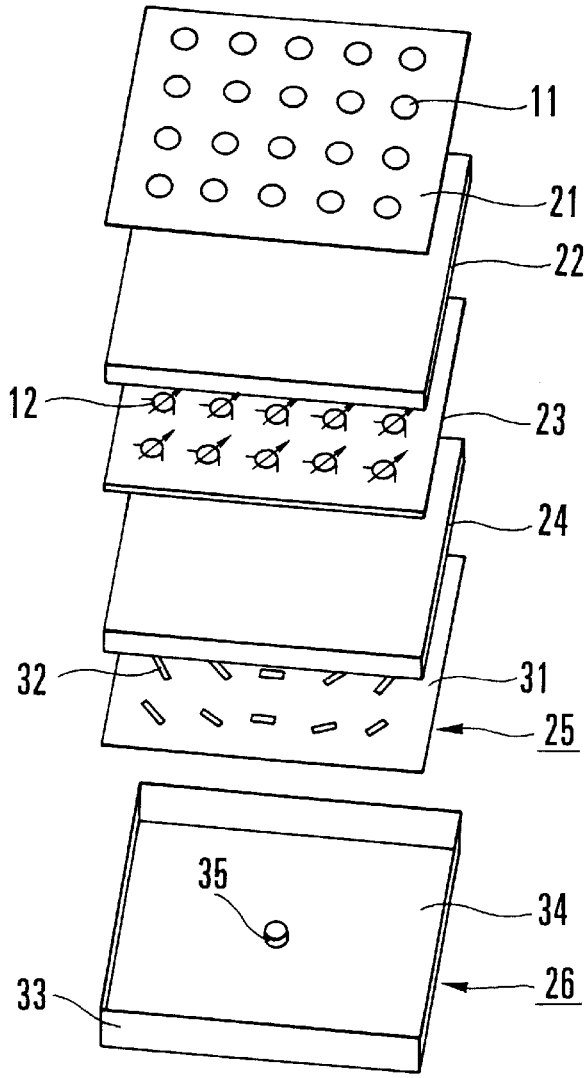
FIG. 3 is an exploded perspective view of the antenna unit shown in FIG. 2

The structure of the antenna unit 1 shown in FIG. 1 will be described next with reference to FIGS. 2 and 3. FIGS. 2 and 3 show the structure of the antenna unit 1.

As shown in FIG. 2, the antenna unit 1 has a multilayered structure. More specifically, a radiation element layer 21, a dielectric layer 22, a phase control layer 23, a dielectric layer 24, and an electromagnetic coupling layer 25 are tightly bonded in the order named to form the antenna unit 1. These layers 21 to 25 are stacked or bonded during the manufacturing process.

A feed radial waveguide 26 is arranged under the electromagnetic coupling layer 25. The layers 21 to 25 and the radial waveguide 26 have a square shape equal in size when viewed from the upper side.

As shown in FIG. 3, the radiation element layer 21 is constituted by the plurality of radiation elements 11 arrayed in a matrix to be driven by electromagnetic coupling. The array of the radiation elements 11 is not limited to the matrix, and any array with a predetermined regularity can be used. For example, the radiation elements 11 may be triangularly or concentrically arrayed.

As the radiation element 11, a circular microstrip patch antenna element is used that has a diameter of about 0.2 to 0.5 times the wavelength of the radio wave to be used. In this case, the circular microstrip patch antenna elements as the radiation elements 11 are spaced apart from each other by a distance corresponding to about 0.2 to 1.2 times the wavelength of the radio wave to be used.

For the dielectric layer 22, a dielectric 42 having a relative dielectric constant of about 1 to 15 is used. The dielectric layer 22 has a uniform thickness dA which is set to be about 0.01 to 0.5 the wavelength of the radio wave to be used.

The phase control layer 23 is constituted by the plurality of phase shifters 12. The phase control layer 23 has the plurality of phase shifters 12, and the phase shifters 12 are arrayed in a matrix in accordance with the same regularity as that of the radiation elements 11 formed on the radiation element layer 21. Each phase shifter 12 of the phase control layer 23 is electromagnetically connected to or coupled to a corresponding one of the radiation elements 11 of the radiation element layer 21.

Figure 4:
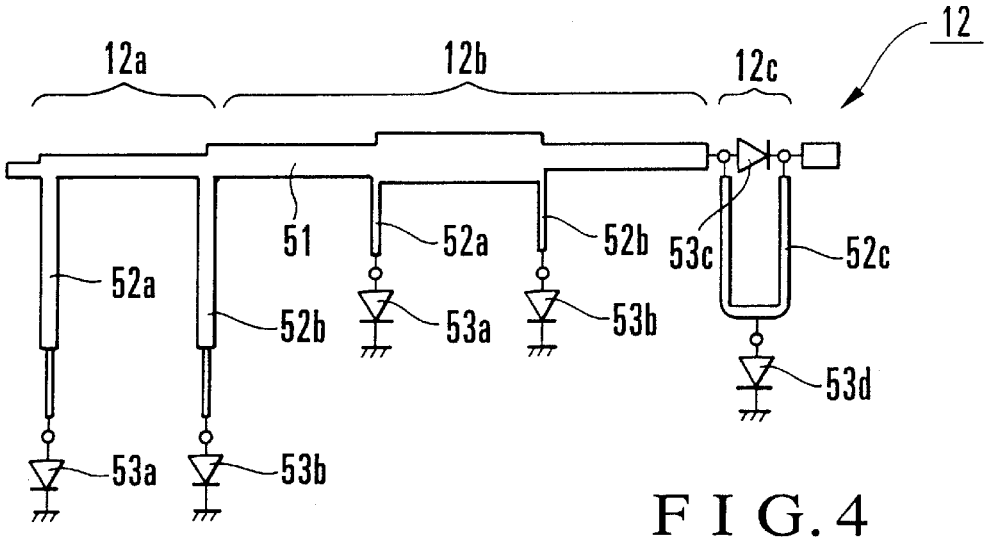
FIG. 4 is a view showing the schematic arrangement of a phase shifter shown in FIGS. 2 and 3.

FIG. 4 shows the schematic arrangement of the phase shifter 12 formed on the phase control layer 23 shown in FIGS. 2 and 3. Referring to FIG. 4, the phase shifter 12 is constituted by a pin diode phase shifter as a 3-bit phase shifter formed by cascade-connecting a 45° phase shifting circuit 12*a*, a 90° phase shifting circuit 12*b*, and a 180° phase shifting circuit 12*c* which can delay the transmitted phase by 45°, 90°, and 180°, respectively.

Each of the 45° phase shifting circuit 12*a* and the 90° phase shifting circuit 12*b* is constituted by a loaded line phase shifter. In each loaded line phase shifter, two branch lines 52*a* and 52*b* are connected to a main line 51, and the distal ends of the branch lines 52*a* and 52*b* are connected to ground through pin diodes 53*a* and 53*b*, respectively.

The 180° phase shifting circuit 12*c* is constituted by a switched line phase shifter. In the switched line phase shifter, a pin diode 53*c* and a U-shaped branch line 52*c* are connected in parallel between the two ends of the disconnected main line 51, and the central portion of the branch line 52*c* is connected to ground through a pin diode 53*d*.

As the main line 51 and the branch lines 52*a* to 52*c*, microstrip lines, triplate lines, or coplanar lines are used.

The pin diodes 53*a* to 53*d* exhibit an impedance close to an open state upon application of a bias voltage in the reverse direction and an impedance close to short circuit upon application of a bias voltage in the forward direction. When the bias voltage in the forward direction is applied to the pin diodes 53*a* to 53*d*, the current flowing through the main line 51 and the branch line 52*c* branches to the pin diodes 53*a* to 53*d*. With this operation, the fed phase can be changed.

The phase control layer 23 has the control lines 3*a*. Each control line 3*a* is connected between the control unit 3 and each bit of the pin diodes 53*a* to 53*d* of the phase shifter 12. The control unit 3 can control the fed phase by selectively applying the forward bias of the pin diodes 53*a* to 53*d* to each bit of the phase shifter 12 through the control line 3*a*.

In FIGS. 2 and 3, for the dielectric layer 24, a dielectric 44 having a relative dielectric constant of about 1 to 15 is used, as in the dielectric layer 22. The dielectric layer 24 is formed to have a uniform thickness dB corresponding to about 0.01 to 0.5 times the wavelength of the radio wave to be used.

The electromagnetic coupling layer 25 has a plurality of electromagnetic coupling holes (coupling means) 32 each having a rectangular shape and formed in a flat conductive plate 31. The coupling holes 32 formed in the electromagnetic coupling layer 25 are arrayed in a matrix in accordance with the same regularity as that of the radiation elements 11 formed on the radiation element layer 21.

Figure 5:
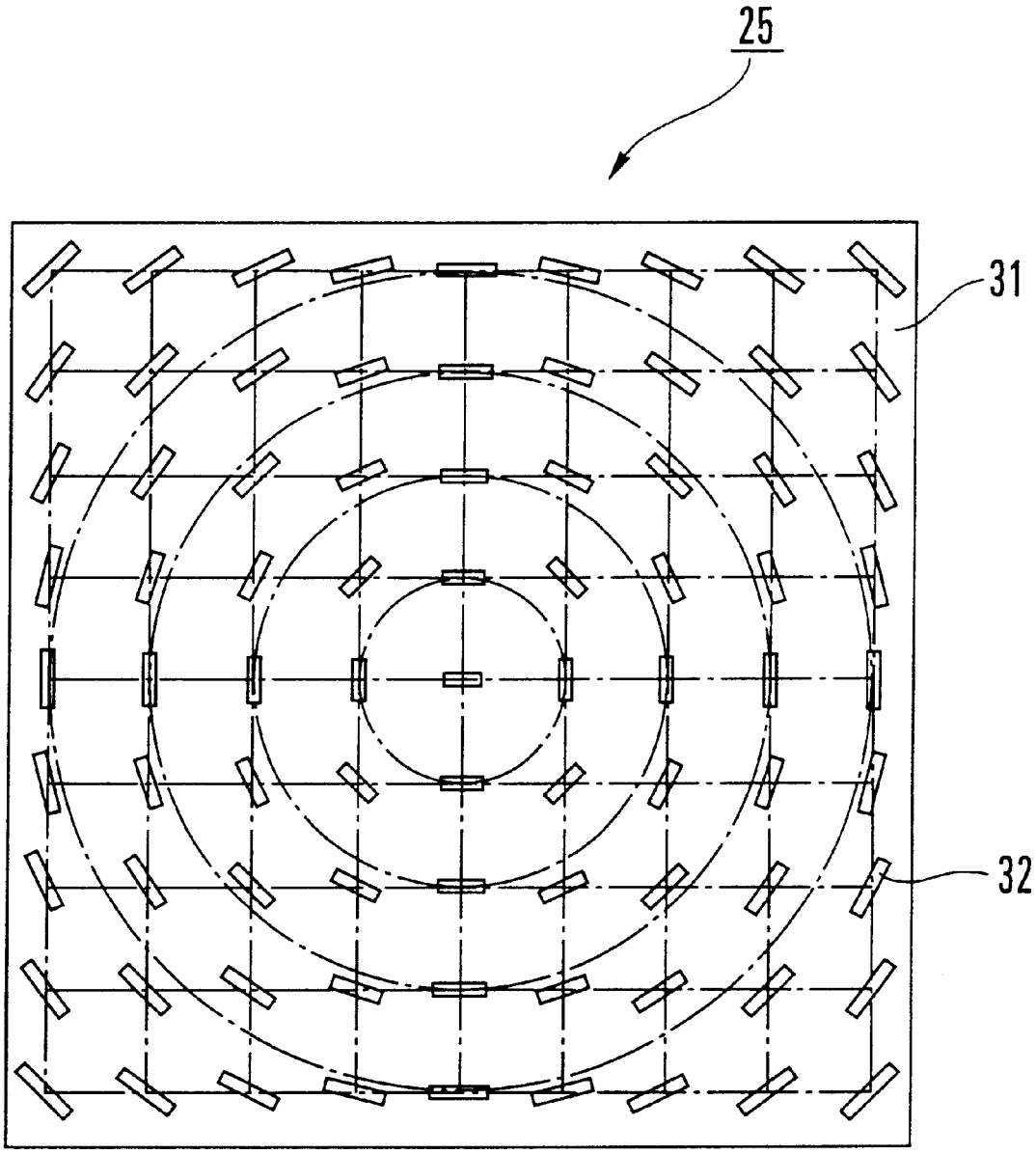
FIG. 5 is a plan view of an electromagnetic coupling layer shown in FIGS. 2 and 3.

FIG. 5 shows the electromagnetic coupling layer 25 shown in FIGS. 2 and 3 when viewed from the upper side. As shown in FIG. 5, each coupling hole 32 is arranged such that the center of the hole matches an intersection of the matrix. In addition, each coupling hole 32 is arranged such that the long side of the hole is parallel to the tangents of concentric circles commonly centered on the center of the flat plate 31.

Each coupling hole 32 of the electromagnetic coupling layer 25 is electromagnetically connected to or coupled to a corresponding one of the phase shifters 12 of the phase control layer 23. The flat plate 31 is grounded. The phase control layer 23 is connected to ground through the flat plate 31 and the through hole (not shown) formed in the dielectric layer 24.

As described above, when a circular microstrip patch antenna element is used as the radiation element 11, each phase shifter 12 and a corresponding one of the coupling holes 32 are spaced apart from each other by a distance corresponding to about 0.2 to 1.2 times the wavelength of the radio wave to be used. Each radiation element 11, a corresponding one of the phase shifters 12, and a corresponding one of the coupling holes 32, which are formed in the layers 21 to 25, constitute one unit.

Figure 6:
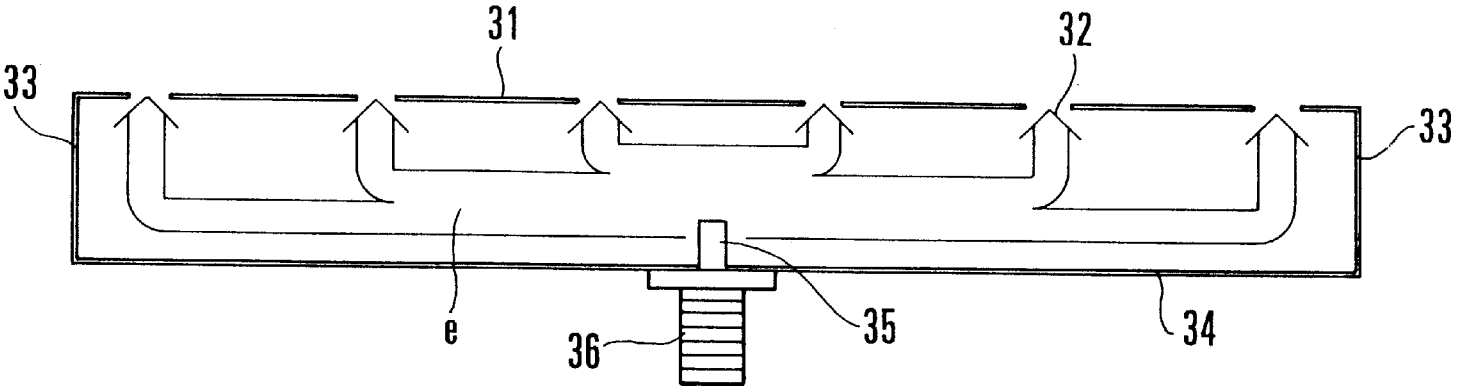
FIG. 6 is a schematic view showing the state of an electromagnetic energy propagating through a feed radial waveguide shown in FIGS. 2 and 3.

As shown in FIG. 6, the feed radial waveguide 26 is comprised of a rectangular ring 33, a bottom plate 34, and the flat plate 31 of the electromagnetic coupling layer 25. The bottom plate 34 and the flat plate 31 of the electromagnetic coupling layer 25 are arranged on the two end surfaces of the ring 33 to be parallel to each other, thereby constituting the waveguide structure. The ring 33 and the bottom plate 34 are made of a conductive material such as a metal or an engineering plastic plated with a metal, like the flat plate 31.

A length D of one side of the section of the radial waveguide 26 is set to be about 3 to 30 times the wavelength of the radio wave to be used. A length (wide of the ring 33) d of the radial waveguide 26 is set to be about 0.01 to 0.5 times the wavelength of the radio wave to be used. The radial waveguide 26 is sometimes filled with a dielectric. A feed unit constituted by the electromagnetic coupling layer 25 and the radial waveguide 26 corresponds to the power distributor 13 shown in FIG. 1.

A feed probe 35 extends through the central portion of the bottom plate 34 of the radial waveguide 26. One end of the feed probe 35 projects from the surface of the bottom plate 34 on the electromagnetic coupling layer 25 side by a length corresponding to ¼ the wavelength of the radio wave to be used. The other end of the feed probe 35 projects outward from the antenna unit 1 and is connected to a coaxial connector 36. The coaxial connector 36 is connected to the power supply unit 2 by the coaxial cable 2*a* shown in FIG. 1.

Referring to FIG. 2, arrows in the radial waveguide 26 indicate a propagation direction k and a field direction E of the electromagnetic wave.

The operation of the radial waveguide 26 will be described next with reference to FIGS. 1 and 2.

The power output from the power supply unit 2 is supplied to the feed probe 35 through the coaxial cable 2*a* and the coaxial connector 36. The feed probe 35 is driven by the supplied power and radiates an electromagnetic wave into the radial waveguide 26.

FIG. 6 schematically shows propagation of an electromagnetic energy, i.e., the electromagnetic wave propagating through the radial waveguide 26. As shown in FIG. 6, an electromagnetic energy e from the feed probe 35 propagates outward from the center of the radial waveguide 26 as a cylindrical wave. The electromagnetic energy e propagating through the radial waveguide 26 is supplied to the phase shifters 12 through the coupling holes 32 formed in the flat plate 31 of the electromagnetic coupling layer 25.

The electromagnetic energy e which is not supplied to the phase shifters 12 through the coupling holes 32 is absorbed by the ring 33 of the radial waveguide 26. The electromagnetic energy e absorbed by the ring 33 is a loss.

When the length of the long side of each coupling hole 32 having a rectangular shape is changed, the amount of the electromagnetic energy e to be supplied through the coupling hole 32 can be adjusted. When the coupling hole 32 is close to the feed probe 35, the electromagnetic energy e is easily supplied to the phase shifter 12. Therefore, as the coupling hole 32 is close to the feed probe 35, the long side is shortened, thereby uniforming the electromagnetic energy e supplied to all the coupling holes 32. By uniformly distributing the electromagnetic energy e, the electromagnetic energy e absorbed by the ring 33 can be minimized.

The electromagnetic energy e passing through the coupling holes 32 is supplied to the phase shifters 12 of the phase control layer 23 through the dielectric layer 24 and controlled in its phase. The phase-controlled electromagnetic energy e excites the radiation elements 11 of the radiation element layer 21 through the dielectric layer 22, and the antenna unit 1 radiates a phase-controlled electromagnetic wave.

Figure 7:
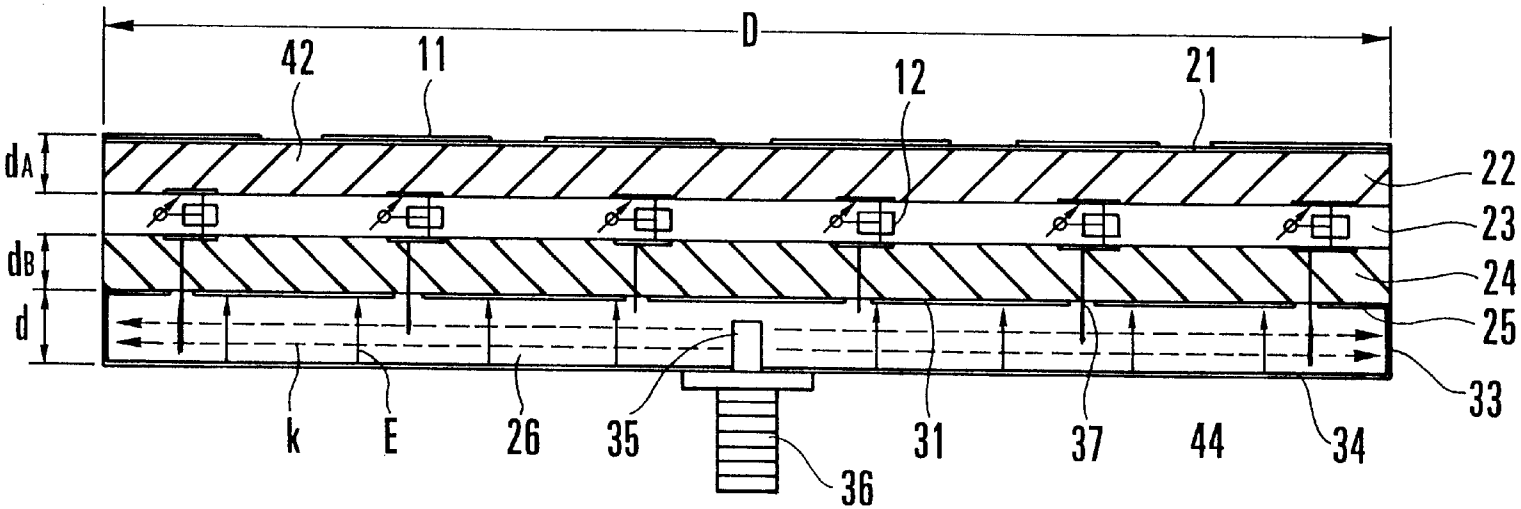
FIG. 7 is a sectional view showing another example of the antenna unit shown in FIG. 1.

FIG. 7 shows another structure of the antenna unit 1 shown in FIG. 1. The same reference numerals as in FIG. 2 denote the same parts in FIG. 7, and a detailed description thereof will be omitted. In this embodiment, coupling probes are used in place of the coupling holes 32 to couple an electromagnetic energy e propagating through a radial waveguide 26 to phase shifters 12.

Referring to FIG. 7, coupling probes 37 connected to the phase shifters 12 are arranged in a dielectric layer 24. The distal end of each coupling probe 37 enters the radial waveguide 26 through the flat plate 31. More specifically, one end of each coupling probe 37 projects from the flat plate 31 into the radial waveguide 26, and the other end is connected a corresponding one of the phase shifters 12 of a phase control layer 23.

When the length of the projecting portion of each coupling probe 37 in the radial waveguide 26 is changed, the amount of the electromagnetic energy e to be coupled to each coupling probe 37 can be adjusted. More specifically, as the distance from the feed probe 35 increases, the length of the projecting portion of the coupling probe 37 in the radial waveguide 26 is set to be longer.

In the above embodiments, a patch antenna is used as the radiation element 11. However, a waveguide slot antenna, a helical antenna, or a dipole antenna may be used. In addition, the antenna unit 1 can have a polygonal or circular shape other than the square shape. Furthermore, in the above embodiments, the long side is changed in accordance with the position of the coupling hole. However, the opening area can be changed by any other method as far as the energy propagation amount can be uniformed.

In the above embodiments, the control unit 3 controls the transmitted phase of each phase shifter 12. However, the control unit 3 may simultaneously control the transmitted amplitude.

As has been described above, according to the present invention, the probe radiates an electromagnetic wave in accordance with the power output from the power supply means, and the electromagnetic wave is coupled to the coupling means connected to the radiation elements. With this operation, the power output from the power supply means is distributed to the radiation elements. Since the loss generated when the electromagnetic wave propagates through the space between the two parallel plates is small, the loss in distributing the power output from the power supply means to the radiation elements can be reduced.

What is claimed is:

1. A phased array antenna apparatus comprising:

a plurality of radiation elements aligned and arranged to be electromagnetically driven;

a power supply which supplies power to said radiation elements;

a power distributor which distributes power supplied from said power supply to said radiation elements, said power distributor having a pair of conductive plates arranged parallel to each other thereby forming a radial waveguide;

a feed probe arranged on one of said conductive plates to radiate an electromagnetic wave into said radial waveguide in accordance with said power supplied from said power supply;

a plurality of electromagnetic couplers arranged on the other of said conductive plates in correspondence with said radiation elements, said electromagnetic couplers extracting the electromagnetic wave radiated from said feed probe, said electromagnetic couplers being in the form of openings disposed within said other of said conductive plates, said openings having an area which increases as a distance between a respective coupler and said feed probe increases; and a plurality of phase shifters which control a phase of the electromagnetic wave extracted by said electromagnetic couplers and which supply the electromagnetic wave to said radiation elements.

2. An apparatus according to claim 1, wherein said openings have a rectangular cross-section with a long side extending in a direction approximately perpendicular to a radius of a circle centered on said feed probe, and the long side of said opening increases as the distance from said feed probe increases.

3. An apparatus according to claim 1, wherein each of said electromagnetic couplers comprises a coupling probe having one end connected to a corresponding phase shifter and an other end projecting into said radial waveguide.

4. The phased array antenna apparatus as claimed in claim 3, wherein:

a length of the other end of said coupling probe which projects into said radial waveguide increases as a distance from said feed probe to a respective coupling probe increases.

5. An apparatus according to claim 1, wherein said apparatus further comprises:

a controller which calculates a transmitted phase of the electromagnetic wave on the basis of a positional relationship between said radiation elements, said feed probe, and a frequency to be used in said electromagnetic wave, and said phase shifter controls the phase of the electromagnetic wave in accordance with said transmitted phase from said controller.

6. An apparatus according to claim 5, wherein:

said controller calculates the transmitted phase and a transmitted amplitude of the electromagnetic wave on the basis of the positional relationship between said radiation elements, said feed probe, and the frequency to be used in said electromagnetic wave, and said phase shifter controls the phase and an amplitude of the electromagnetic wave in accordance with said transmitted phase and said transmitted amplitude output from said controller.

7. An apparatus according to claim 1, wherein each said radiation element comprises a circular microstrip patch antenna, and said phase shifter comprises a digital phase shifter.

8. An apparatus according to claim 1, wherein said apparatus further comprises:

an electromagnetic coupling layer stacked on said radial waveguide and having said electromagnetic couplers, a phase control layer stacked on said electromagnetic coupling layer and having said phase shifter, and a radiation element layer stacked on said phase control layer and having said radiation elements, thereby forming an antenna.

9. An antenna apparatus comprising:

a plurality of radiation elements;

a waveguide having a feed probe; and a plurality of electromagnetic couplers in the form of openings disposed on said waveguide and providing electromagnetic access between said radiation elements and said waveguide;

wherein said openings each have an area which increases as a distance between a respective electromagnetic coupler and said feed probe increases.

10. The antenna apparatus as claimed in claim 9 further comprising:

an electromagnetic source feeding said feed probe;

a plurality of phase shifters which control a phase of an electromagnetic wave created by said electromagnetic source, said phase shifters being disposed between said electromagnetic couplers and said radiation elements.

11. The antenna apparatus as claimed in claim 9 wherein:

said openings have a rectangular cross-section with a long side extending in a direction approximately perpendicular to a radius of a circle centered on said electromagnetic source, and the long side of said openings increases as the distance between a coupler and said feed probe increases.

12. The antenna apparatus as claimed in claim 9 wherein each of said electromagnetic couplers comprises a coupling probe having one end connected to a corresponding radiation element and an other end projecting into said waveguide.

13. The antenna apparatus as claimed in claim 12 wherein a length of the other end of said coupling probe which projects into said waveguide increases as a distance from said feed probe to a respective coupling probe increases.

14. The antenna apparatus as claimed in claim 13 further comprising:

an electromagnetic source which feeds said feed probe; and a plurality of phase shifters which control a phase of an electromagnetic wave created by said electromagnetic source, said phase shifters being disposed between said electromagnetic couplers and said radiation elements; wherein said openings have a rectangular cross-section with a long side extending in a direction approximately perpendicular to a radius of a circle centered on said electromagnetic source, and the long side of said openings increases as the distance between a respective coupler and said electromagnetic source increases.

15. An antenna apparatus comprising:

a waveguide adapted to transmit electromagnetic energy, said electromagnetic energy varying in amplitude at different positions along said waveguide;

a plurality of radiation elements; and a plurality of electromagnetic couplers coupling different portions of said waveguide to said radiation elements, said electromagnetic couplers being in the form of openings, said openings having a rectangular cross-section with a long side extending in a direction approximately perpendicular to a radius of a circle centered on an electromagnetic source supplying said electromagnetic energy, said long side of said openings increases as the distance between a coupler and said electromagnetic source increases, wherein said electromagnetic couplers are arranged so as to provide each of said radiation elements with substantially the same amount of electromagnetic energy.

16. The antenna apparatus as claimed in claim 15 further comprising a plurality of phase shifters which control a phase of an electromagnetic wave created by said electromagnetic source, said phase shifters being disposed between said electromagnetic couplers and said radiation elements.

17. The antenna apparatus as claimed in claim 16 wherein there is the same number of radiation elements, electromagnetic couplers, and phase shifters.

18. The antenna apparatus as claimed in claim 15 wherein a number of electromagnetic couplers equals a number of radiation elements.

19. An antenna apparatus comprising:

a waveguide adapted to transmit electromagnetic energy, said electromagnetic energy varying in amplitude at different positions along said waveguide;

a plurality of radiation elements; and a plurality of electromagnetic couplers coupling different portions of said waveguide to said radiation elements, wherein said electromagnetic couplers are arranged so as to provide each of said radiation elements with substantially the same amount of electromagnetic energy;

an electromagnetic source feeding said waveguide and having a feed probe; and a plurality of phase shifters which control a phase of an electromagnetic wave created by said electromagnetic source, said phase shifters being disposed between said electromagnetic couplers and said radiation elements; wherein said electromagnetic couplers are in the form of openings;

said openings have a rectangular cross-section with a long side extending in a direction approximately perpendicular to a radius of a circle centered on said electromagnetic source, and the long side of said openings increases as the distance between a respective coupler and said electromagnetic source increases.

* * * * *